US005456307A

United States Patent [19]

Mouri

[11] Patent Number: 5,456,307

[45] Date of Patent: Oct. 10, 1995

[54] STARTER BAR HEAD FOR A CONTINUOUS CASTER

[75] Inventor: Kazunori Mouri, Traun, Austria

[73] Assignee: Voest-Alpine Industrieanlagenbau GmbH, Austria

[21] Appl. No.: 193,959

[22] Filed: Feb. 9, 1994

[30] Foreign Application Priority Data

Feb. 12, 1993 [AT] Austria ..... A259/93

[51] Int. Cl.[6] ..... B22D 11/08

[52] U.S. Cl. ..... 164/446; 164/426

[58] Field of Search ..... 164/445, 446, 164/425, 426

[56] References Cited

U.S. PATENT DOCUMENTS 4,719,960 1/1988 Grotha et al. ..... 164/446

FOREIGN PATENT DOCUMENTS 0320681 11/1988 European Pat. Off. .
0234299 4/1992 European Pat. Off. .
1608089 11/1970 Germany .

*Primary Examiner*—Kuang Y. Lin
*Attorney, Agent, or Firm*—Ostrolenk, Faber, Cerb & Soffen

[57] ABSTRACT

There is provided a starter bar head for a continuous caster, which includes a lower part capable of being introduced into the mold cavity of a continuous casting mold at least partially and on whose upper surface at least one re-entrant groove is provided, and a sealing mat of refractory material whose peripheral edge is placeable into contact with the mold side walls. At least one connection element having a projection reaching into the mold cavity is fastenable to the lower part and is connectable with the cast strand by casting-on. In order to enable the easy detachment of the starter bar from the cast strand and to be able to assemble the starter bar head in a simple manner, the connection element includes two superimposed plates, the upper plate being provided with the projection and the lower plate being clampable relative to the upper plate upon insertion of the sealing mat. The lower part, on its side directed towards the upper surface of the lower part, is provided with a groove counter-element projecting into the re-entrant groove and being slidably guided within the groove independent of the clamping forces prevailing between the plates.

7 Claims, 1 Drawing Sheet

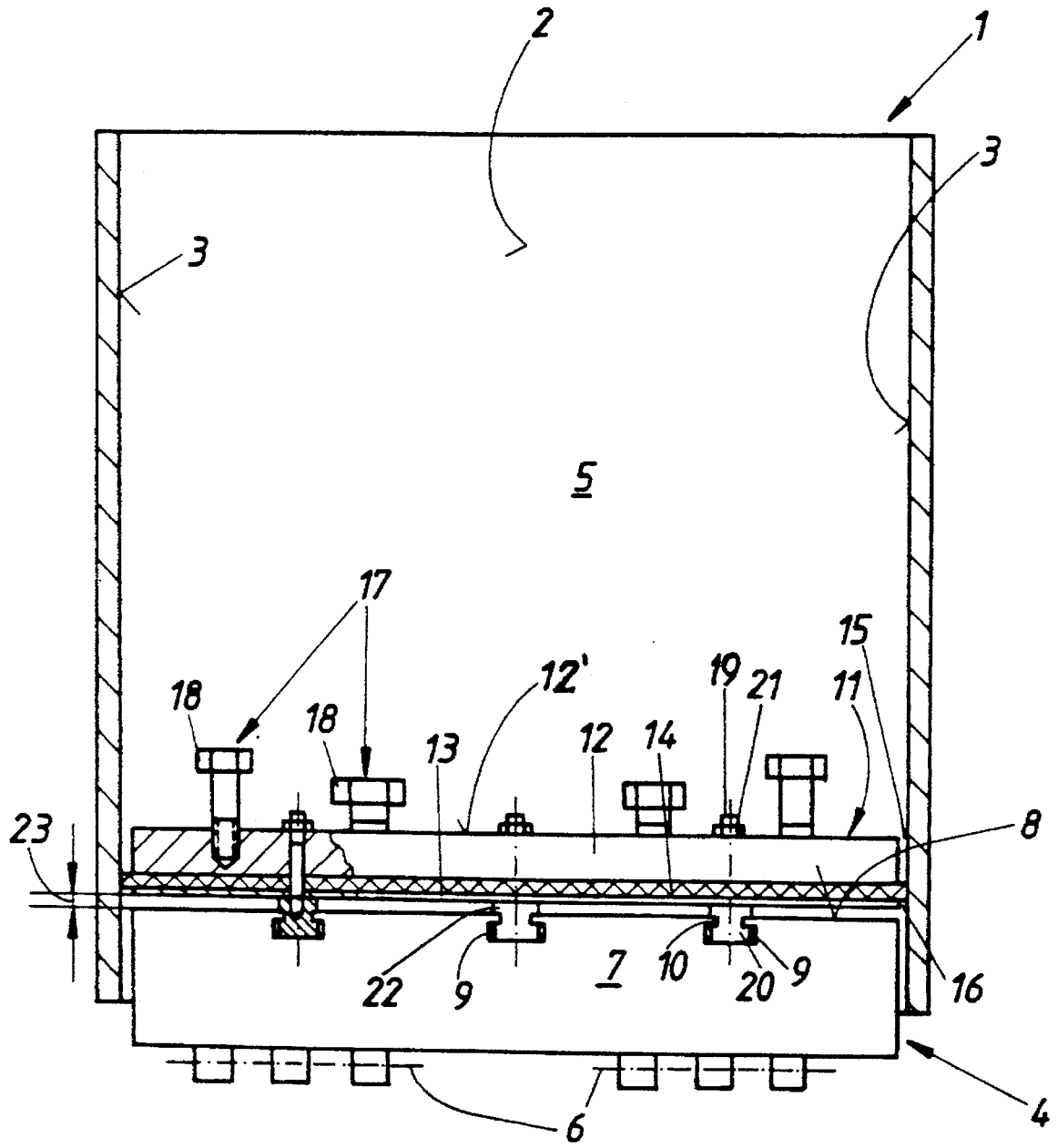
2
1
3
3
5
17
15
12'
19
21
11
18
18
13
12
14
23
8
22
9
7
10
20
9
16
6
4

STARTER BAR HEAD FOR A CONTINUOUS CASTER

BACKGROUND OF THE INVENTION

1. Field of the Invention

The invention relates to a starter bar head for a continuous caster, in particular a steel strip caster, comprising a lower part capable of being introduced into the mold cavity of a continuous casting mold at least partially and on whose upper surface at least one re-entrant groove is provided, at least one connection element having a projection reaching into the mold cavity and formed of two superimposed plates, the upper plate being provided with the projection, which connection element is fastenable to the lower part and is connectable with the cast strand by casting-on, and a sealing mat of refractory material whose peripheral edge is placeable into contact with the mold side walls.

2. Description of the Related Art

A starter bar head of this type is known from EP-A-0 234 299. With this known starter bar head, the sealing mat of refractory material is inserted between the connection element and the upper surface of the lower part. The connection element is clampable relative to the lower part by means of screws, thus fixing the sealing mat. The screws, with their heads, are inserted in transverse grooves extending transverse over the upper surface of the lower part, and pass through the sealing mat and the connection element. On the screw bolts of the screws projecting beyond the upper side of the connection element, nuts are screwed, by aid of which the connection element is clampable relative to the lower part.

When casting on, the nuts weld both with the screw bolts and with the cast strand, loosening of the screw connections, thus, being no longer possible. In order to be able to separate the starter bar or starter bar head from the cast strand, it is necessary to drive the screw heads laterally out of the transverse grooves, which, however, is feasible only by applying excessive force—depending on the clamping force applied by each of the nuts. Driving out of the screw heads from the transverse grooves involves the danger of damaging the transverse grooves, which precludes the repeated use of the starter bar head, i.e., of its lower part.

Moreover, jamming of the screw heads within the grooves may result from thermal stresses and thermal expansions of the connection element such that the screw heads can be driven out of the transverse grooves only by exerting force, if at all.

A further disadvantage of the known construction is to be seen in that the preparation of the starter bar head, i.e., providing the lower part with a sealing mat and a connection element, must be carried out directly at the starter bar and hence in the casting hall.

SUMMARY OF THE INVENTION

The invention overcomes these disadvantages and difficulties and provides a starter bar head of the initially defined kind, which further enables the easy detachment of the starter bar from the cast strand, which can be assembled in a simple manner and whose assembly, inasmuch as parts to be screwed are concerned, need not be effected directly at the starter bar, but may be effected away from the casting hall, e.g., in a workshop. In addition, the frequent use of as many parts as possible, in particular of parts whose production is expensive and complex, such as the lower part, is possible.

In accordance with the invention, the plates of the connection elements are arranged to be superimposed at a distance from each other, the lower plate being clampable relative to the upper plate upon insertion of the sealing mat, and the lower plate, on its side directed towards the upper surface of the lower part, is provided with a groove counter-element projecting into the re-entrant groove and being slidably guided within the groove independent of the clamping forces prevailing between the plates.

The particular advantage of the starter bar head according to the invention is that the separation of the connection element connected with the cast strand from the lower part of the starter bar is feasible in a particularly simple manner by pushing the groove counter-elements out of the grooves, which pushing out is completely independent of the clamping force by which the two superimposed plates of the connection element are pressed toward at each other. The two plates with the sealing mat interposed therebetween can be clamped relative to each other in a workshop such that the precise assembly of these parts of the starter bar head is feasible, whereby precise positioning of the sealing mat clamped between these two plates, and a perfect tightness, are obtainable without special means.

Prior to using the starter bar, merely the connection element to which the sealing mat has already been fixed need be fixed to the lower part of the starter bar head, which may be accomplished by inserting the groove counter-elements of the connection element into the grooves of the lower pan. Such connection elements, therefore, can be produced in advance and kept on stock, thus making a starter bar ready for use within a very short time.

A structurally very simple embodiment is characterized in that the two plates of the connection element are clampable relative to each other by at least one screw connection, one end of the screw connection being detachably connected with the groove counter-element. With this embodiment, the groove counter-element fulfills a double function, i.e., the function of fastening and guiding within the grooves, on the one hand, and the absorption of the clamping force applied by the screws by the groove counter-elements without thereby restricting the retaining and guiding function of the groove counter-elements, on the other hand.

Advantageously, a distance forming an air gap is provided between the upper surface of the lower part and the lower side of the lower plate of the connection element. Thereby, the thermal flow towards the lower part of the starter bar head will be reduced. This air gap suitably has a dimension of between 5 and 50 mm.

A preferred embodiment is characterized in that the groove counter-element has a collar extending beyond the upper surface of the lower part, which collar serves as a spacer for fixing the distance between the upper surface of the lower part and the lower plate of the connection element and provides for an abutment surface for the lower plate.

Suitably, the upper plate of the connection element, in the direction of the plane formed by it, has cross-sectional dimensions that are smaller than the cross-sectional dimensions of the mold cavity so as to form a peripheral distance relative to the mold side walls.

For a better support of the sealing mat, the lower plate of the connection element, in the direction of the plane formed by it, advantageously has cross-sectional dimensions that are larger than those of the upper plate, yet are smaller than those of the mold cavity.

In the following, the invention will be explained in more detail by way of an exemplary embodiment illustrated in the drawing.

BRIEF DESCRIPTION OF THE DRAWING

The drawing is a cross-sectional view showing a preferred embodiment of the starter bar head of the present invention.

DETAILED DESCRIPTION OF THE PREFERRED EMBODIMENT

In a mold 1 formed of broad side walls 2 and narrow side walls 3 and whose cross section is adapted to casting a strand having strip cross section, a starter bar head 4 is inserted, which partially projects into the mold cavity 5. The starter bar head is articulately connected with a starter bar (not illustrated) via schematically represented articulations 6.

The starter bar head 4 itself is comprised of a lower part 7, on whose upper surface 8—which also projects into the mold cavity 5—several transverse grooves 9 are provided, which have T-shaped cross-sections and are arranged parallel to one another. Thus, undercuts 10 acting towards the upper surface 8 are formed. The number of transverse grooves 9 is a function of the width of the mold cavity 5.

The lower part 7 of the starter bar head 4 carries a connection element 11, which comprises two superimposed plates 12, 13 of steel plate, between which a sealing mat 14 of refractory material, for instance, of asbestos cloth, is inserted. The area extension of the two plates 12, 13 approximately corresponds to the cross section of the continuous casting mold, yet is dimensioned to be slightly smaller than the same such that each of the plates 12, 13 presents a peripheral distance 15, 16 relative to the mold side walls 2, 3 with the plates 12, 13 inserted in the mold cavity 5. However, the peripheral distance 16 of the lower plate 13 relative to the mold side walls 2, 3 is dimensioned to be slightly smaller, i.e., the lower plate 13 laterally protrudes beyond the upper plate 12 such that the sealing mat 14 is well supported by the lower plate 13 close to the mold side walls 2, 3, on which the sealing mat abuts, at least at its peripheral edge.

The thickness of the upper plate 12 is dimensioned in correspondence with the tensile forces to be applied in withdrawing the cast strand and with the amount of heat to be absorbed such that the steel melt, after having been poured into the mold cavity 5, solidifies on the upper plate 12, leaving the sealing mat 14 largely untouched. The thickness of the lower plate 13 is dimensioned to be substantially smaller, because this plate 13 does not have to accommodate substantially any forces apart from fulfilling a supporting function for the sealing mat 14. In the upper plate 12, projections 17 oriented towards the mold cavity 5 are inserted, e.g., screw bolts are screwed in, whose heads 18 come to lie at a distance from the upper side 12' of the upper plate 12. The number of projections 17 is a function of the width of the mold cavity 5.

Fastening of the upper plate 12 to the lower plate 13, and clamping of the upper plate 12 relative to the lower plate 13 are accomplished by means of a screw connection formed by screw bolts 19, whichs crew bolts 19 pass through the two plates 12, 13 and the sealing mat 14 and are screwed in groove counter-elements 20 slidably guided within the grooves 9. The groove counter-elements 20 are dimensioned such that they are displaceable within the grooves 9 without any particular force being required therefor.

As is apparent from the drawing, the upper plate 12 is clamped relative to the lower plate 13 by nuts 21 screwed on the screw bolts 19. Instead of this embodiment, a screw abutting on the upper side 12' of the upper plate 12 by its head could be screwed in the groove counter-element 20 until the required clamping force, i.e., clamping between the upper plate 12 and the lower plate 13, has been reached.

The groove counter-elements 20 each comprise a collar 22 extending over the upper surface 8 of the lower part 7 of the starter bar head 4, forming a supporting surface for the lower side of the lower plate 13 of the connection element 11. Thereby, the lower plate 13 comes to lie at a distance 23 from the upper surface 8 of the lower part 7 of the starter bar head 4, the height of the air gap formed between the lower plate 13 of the connection element 11 and the upper surface 8 of the lower part 7 corresponding to the height of this collar 22. The air gap provide heat insulation, thus strongly reducing the thermal flow towards the lower part 7 of the starter bar head and leaving the slidability of the groove counter-elements 20 within the grooves 9 unaffected. The height of the air gap preferably ranges between 5 and 50 mm.

After casting-on, when welding of the projections 17 reaching into the mold cavity 5 with the cast strand has been effected, the cast strand fixed to the connection element 11 may be readily detached from the lower part 7 of the starter bar head 4 by the lower pan 7 carrying out a relative movement relative to the cast strand in the direction along the grooves 9. Thereby, the groove counter-elements 20 slide out of the grooves 9, the separation thus being accomplished. The groove counter-elements 20 may be screwed off the screw bolts 19 or screws and used again.

The connection element 11 can be completely screwed together in a workshop while precisely positioning the sealing mat 14 such that, in the casting hall, it merely need be slipped on the lower part 7 of the starter bar head 4, which may remain on the starter bar. Insertion or clamping of the sealing mat 14 or any other screwing operation no longer need be performed in the casting hall.

The starter bar head 4 according to the invention, furthermore, offers the advantage of being readily kept on stock, because a lower part 7 can be provided with a connection element 11 that corresponds to the desired strand format within an extremely short time and only those connection elements 11 which have different dimensions according to different mold cross-sectional formats need be kept on stock. The starter bar can be threaded into the mold cavity 5 both from below and from above.

What I claimed is:

1. In a starter bar head to be used with a continuous casting arrangement for producing a cast strand which starter bar head includes:

a lower part having an upper surface, at least one re-entrant groove being provided on said upper surface;

at least one connection element having a projection, which connection element includes:

a lower plate;

an upper plate superimposed on said lower plate and provided with said projection, said upper plate being fastenable to said lower part; and a sealing mat made of refractory material and having a peripheral edge;

the improvement wherein:

said lower and upper plates of said connection element are superimposed at a distance from each other, said lower plate being clampable relative to said upper plate upon insertion of said sealing mat therebetween; and said connection element further comprises a groove counter-element provided on said lower plate on its side directed towards said upper surface of said lower part, said groove counter-element projecting into said re-entrant groove and being slidably guided within said groove independent of clamping forces prevailing between said lower and upper plates.

2. A starter bar head as set forth in claim 1, further comprising at least one screw connection means configured to clamp said lower and upper plates of said connection element relative to each other, one end of said screw connection means being detachably connected with said groove counter-element.

3. A starter bar head as set forth in claim 1, wherein a distance is provided between said upper surface of said lower part and the lower side of said lower plate of said connection element for forming an air gap.

4. A starter bar head as set forth in claim 3, wherein said distance is between 5 and 50 mm.

5. A starter bar head as set forth in claim 3, further comprising a collar provided on said groove counter-element and extending beyond said upper surface of said lower part, said collar being configured to serve as a spacer for fixing said distance between said upper surface of said lower part and said lower plate of said connection element and including a supporting surface for said lower plate.

6. A starter bar head as set forth in claim 1, wherein said sealing mat has sealing mat cross-sectional dimensions and said upper plate of said connection element, in the direction of the plane formed by it, has upper plate cross-sectional dimensions, said upper plate cross-sectional dimensions being smaller than said sealing mat cross-sectional dimensions so as to provide for a peripheral distance relative to said sealing mat peripheral edge.

7. A starter bar head as set forth in claim 1, wherein said sealing mat has sealing mat cross-sectional dimensions, said lower plate of said connection element, in the direction of the plane formed by it, has lower plate cross-sectional dimensions, and said upper plate of said connection element, in the direction of the plane formed by it, has upper plate cross-sectional dimensions, said lower plate cross-sectional dimensions being larger than said upper plate cross-sectional dimensions, yet smaller than said sealing mat cross-sectional dimensions.

* * * * *